United States Patent [19]

White

[11] 4,084,701

[45] Apr. 18, 1978

[54] TRASH CAN SECURING DEVICE

[75] Inventor: Thomas L. White, DeSoto, Mo.

[73] Assignee: The Raymond Lee Organization, Inc., New York, N.Y. ; a part interest

[21] Appl. No.: 796,227

[22] Filed: May 12, 1977

[51] Int. Cl.[2] ..... A47G 29/00; B65F 1/00

[52] U.S. Cl. ..... 211/81; 248/154; 248/DIG. 7

[58] Field of Search ..... 211/71, 74, 76, 77, 211/79-85, 4, 8; 248/DIG. 7, 128, 130, 133, 135, 136-142, 146-154, 201, 203, 313, 316 R, 316 B

[56] References Cited

U.S. PATENT DOCUMENTS

| | | | |
|---|---|---|---|
| 1,292,329 | 1/1919 | Johnson | 211/80 |
| 2,102,914 | 12/1937 | Reinks et al. | 248/147 |
| 2,304,810 | 12/1942 | Fetterman | 248/DIG. 7 |
| 2,546,449 | 3/1951 | Herdy | 248/147 |
| 2,639,113 | 5/1953 | Kriz | 248/147 |
| 3,063,591 | 11/1962 | Laginestra | 248/154 X |
| 3,469,709 | 9/1969 | Wood | 211/82 |
| 3,603,550 | 9/1971 | Byrd | 248/154 |
| 3,933,328 | 1/1976 | Michelbrink | 248/DIG. 7 |

*Primary Examiner*—Roy D. Frazier

*Assistant Examiner*—Terrell P. Lewis

*Attorney, Agent, or Firm*—Daniel Jay Tick

[57] ABSTRACT

A first pair of semicylindrical frame basket retainers are hingedly affixed to a horizontal platform in spaced relation and open in opposite directions. A linking device is mounted on the platform between the first pair of basket retainers and is pivotally coupled to each of the retainers at distances above the platform for rotating the retainers about their hinges under the control of a user. A latch device mounted on the platform between the first pair of retainers releasably secures the retainers in positions of inclination relative to the platform. A second pair of semicylindrical frame basket retainers are affixed to the platform in a manner whereby the first basket retainers and second basket retainers are paired to form a pair of cylindrical trash can retainers, each pair of trash can retainers having a basket retainer of the first pair and a basket retainer of the second pair. Springs couple the basket retainer of the first pair to the basket retainer of the second pair in each pair of trash can retainers in a manner whereby when the latches are released, the first pair of basket retainers are forced into horizontal positions corresponding with the cooperating second pair of retainers.

3 Claims, 2 Drawing Figures

TRASH CAN SECURING DEVICE

BACKGROUND OF THE INVENTION

The present invention relates to a trash can securing device. More particularly, the invention relates to a trash can securing device for releasably securing a pair of trash cans against marauding animals and the like.

Objects of the invention are to provide a trash can securing device of simple structure, which is inexpensive in manufacture, used with facility and convenience, and functions efficiently, effectively and reliably to prevent a pair of trash cans from being opened, turned over, or disrupted in any manner by marauding animals, high winds, or the like.

BRIEF DESCRIPTION OF THE DRAWINGS

In order that the invention may be readily carried into effect, it will now be described with reference to the accompanying drawings, wherein.

DETAILED DESCRIPTION OF THE INVENTION

The trash can securing device of the invention functions to releasably secure a pair of trash cans 1 and 2 against marauding animals, and the like.

The trash can securing device comprises a platform 3 secured in a substantially horizontal plane. The platform 3 may be provided with sufficiently shaped ground pegs or the like at each of its four corners to securely anchor it in the ground. Two of the four ground pegs, 4 and 5, are shown in FIG. 2.

Figure 2:
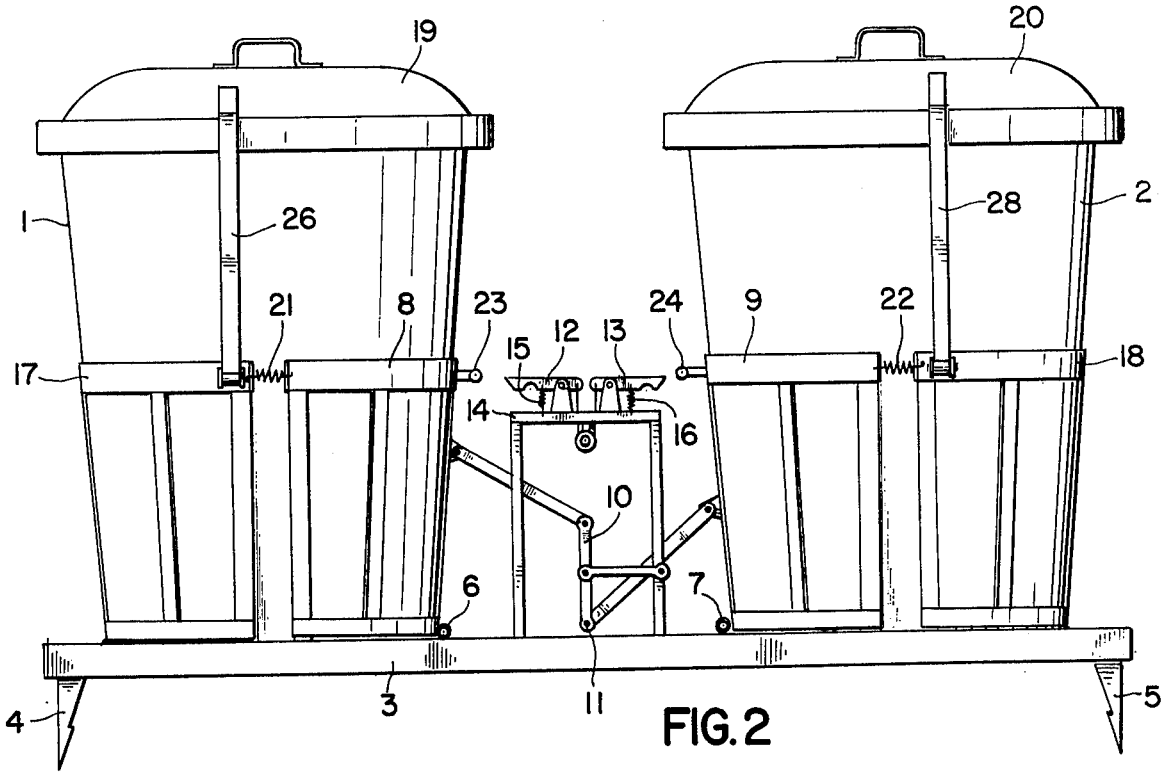
FIG. 2 is a side view, on an enlarged scale, of the embodiment of FIG. 1, in use.

A pair of hinges 6 and 7 are provided (FIG. 2). A first pair of substantially semicylindrical frame basket retainers 8 and 9 are hingedly affixed by the hinges 6 and 7, respectively, to the platform 3 in spaced relation, opening in opposite directions.

A linking device 10 is mounted on the platform 3 between the first pair of basket retainers 8 and 9 and is pivotally coupled to each of the basket retainers 8 and 9 at distances above said platform for rotating said basket retainers about their hinges 6 and 7, respectively, under the control of a user. This is facilitated by a handle 11. When the handle is rotated clockwise, the first pair of basket retainers 8 and 9 are tilted, as hereinafter described, and when said handle is rotated counterclockwise, said basket retainers are positioned on the platform 3, as shown in the Figures.

A pair of latches 12 and 13 are mounted on the platform 3 between the first pair of basket retainers 8 and 9 for releasably securing said basket retainers in positions of inclination relative to said platform. The latches 12 and 13 are mounted on a platform 14 above the platform 3 and are spring biased by springs 15 and 16, respectively, so that they are constantly urged in a downward direction toward the platform 14.

Figure 1:
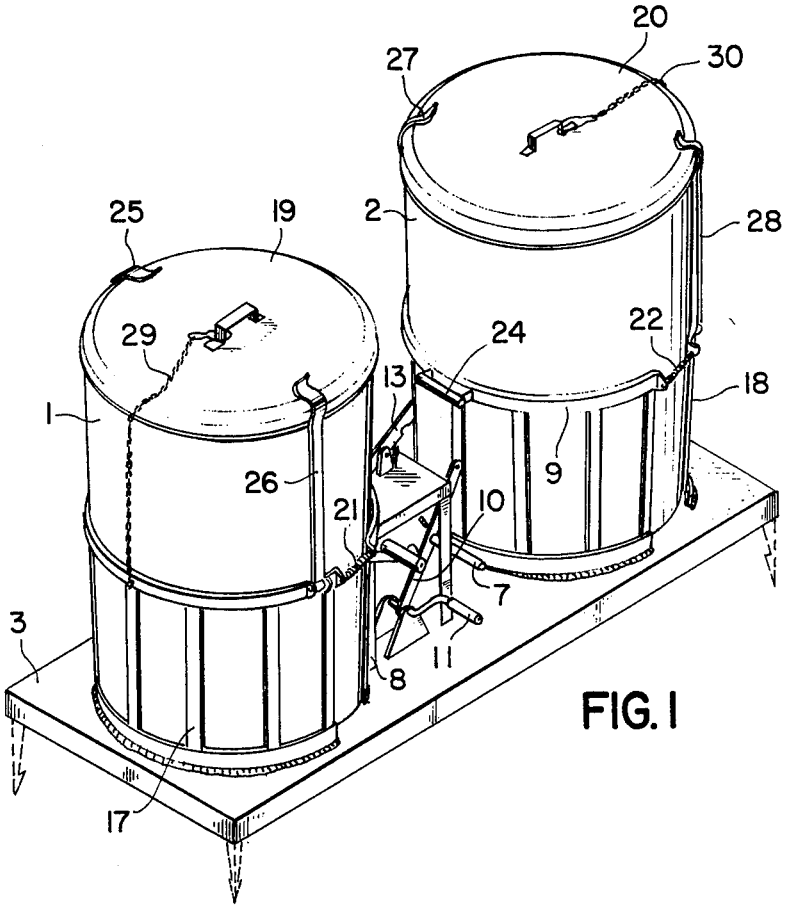
FIG. 1 is a perspective view of an embodiment of the trash can securing device of the invention in use.

A second pair of semicylindrical frame basket retainers 17 and 18 are affixed to the platform 3 in a manner whereby the first basket retainers 8 and 9 and said second basket retainers are paired to form a pair of substantially cylindrical trash can retainers. Thus, the first basket retainer 8 is paired with the second basket retainer 17 to form the first substantially cylindrical trash can retainer and the first basket retainer 9 is paired with the second basket retainer 18 to form the second substantially cylindrical trash can retainer. The first pair of trash can retainers 8, 17 releasably secures the first trash can 1 in upright and closed lid condition with its lid 19 secured thereto. The second pair of trash can retainers 9, 18 releasably secures the trash can 2 in upright and closed lid condition with its lid 20 secured thereto. A pair of springs, of which only one spring 21 is shown in FIGS. 1 and 2, couples the basket retainer 8 of the first pair to the basket retainer 17 of the second pair. A pair of springs, of which only the spring 22 is shown in FIGS. 1 and 2, couples the basket retainer 9 of the first pair to the basket retainer 18 of the second pair. The second spring of each pair is diametrically opposite that shown in the Figures, so that it is not seen in the Figures.

A handle 23 is affixed to the first basket retainer 8 of the first pair and a handle 24 is affixed to the second basket retainer 9 of the first pair of basket retainers (FIG. 2). When it is desired to remove the trash cans 1 and 2, the user turns the handle 11 clockwise and may grasp either handle 23 or 24 thereby rotating the basket container 8 in a clockwise direction to a position of inclination relative to the platform 3 and rotating the basket retainer 9 in a counterclockwise direction to a position of inclination with said platform. As soon as the basket retainers 8 and 9 are inclined at a sufficient angle, the latches 12 and 13 grasp the handles 23 and 24 and secure said basket retainers in their inclined positions. The user may then remove the trash cans 1 and 2, as desired, after releasing the lid clamping members, as hereinafter described.

When the trash cans 1 and 2 are to be secured in upright position, they are placed in the basket retainers 17 and 18 and the latches 12 and 13 are released, whereby the pair of springs of which the spring 21 is shown, rotate the basket retainer 8 in a clockwise direction until it rests on the platform 13 in its position shown in FIG. 2 and the pair of springs of which the spring 22 is shown, rotates the basket retainer 9 in a clockwise direction until it rests on said platform in its position shown in the Figures.

A first pair of lid clamping members 25 and 26 are affixed to the basket retainer 17 for releasably maintaining the lid 19 on the trash can 1. A second pair of lid clamping members 27 and 28 are affixed to the basket retainer 18 for releasably maintaining the lid 20 on the trash can 2. Each of the lid clamping members 25, 26, 27 and 28 is pivotally mounted on the corresponding basket retainer, as shown in FIG. 2, for the clamping members 26 and 28, so that it is readily moved toward or away from the lid of the corresponding trash can.

The lids 19 and 20 are secured from loss by chains 29 and 30, respectively, which are affixed at one end to the lids 19 and 20, respectively, and at the other end to the basket retainers 17 and 18, respectively.

While the invention has been described by means of a specific example and in a specific embodiment, I do not wish to be limited thereto, for obvious modifications will occur to those skilled in the art without departing from the spirit and scope of the invention.

I claim:

1. A trash can securing device for releasably securing a pair of trash cans against marauding animals, and the like, said trash can securing device comprising a platform secured in a substantially horizontal plane;

hinge means;

a first pair of substantially semicylindrical frame basket retainers, hingedly affixed by said hinge means to the platform in spaced relation and opening in opposite directions;

a linking device mounted on the platform between the first pair of basket retainers and pivotally coupled to each of said basket retainers at distances above the platform for rotating said basket retainers about their hinge means under the control of a user;

latch means mounted on the platform between the first pair of basket retainers for releasably securing the basket retainers in positions of inclination relative to the platform;

a second pair of substantially semicylindrical frame basket retainers affixed to the platform in a manner whereby said first basket retainers and said second basket retainers are paired to form a pair of substantially cylindrical trash can retainers, each pair of trash can retainers having a basket retainer of the first pair and a basket retainer of the second pair; and spring means coupling the basket retainer of the first pair to the basket retainer of the second pair in each pair of trash can retainers in a manner whereby when the latch means are released the first pair of basket retainers are forced into substantially horizontal positions corresponding with the cooperating second pair of basket retainers.

2. A trash can securing device as claimed in claim 1, further comprising two pairs of lid clamping members each pair being affixed to a corresponding one of the second pair of basket retainers for releasably maintaining a lid on a trash can secured therein.

3. A trash can securing device as claimed in claim 1, further comprising a pair of handles each affixed to a corresponding one of the first pair of basket retainers.

* * * * *